US009337627B2

(12) United States Patent
Zheng et al.

(10) Patent No.: US 9,337,627 B2
(45) Date of Patent: May 10, 2016

(54) METHOD OF APPLYING A COATING TO A SPARK PLUG INSULATOR

(71) Applicant: Fram Group IP, LLC, Lake Forest, IL (US)

(72) Inventors: Jing Zheng, Findlay, OH (US); Prabhu Megharaj, Findlay, OH (US); Jeffrey T. Boehler, Holland, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 14/710,039

(22) Filed: May 12, 2015

(65) Prior Publication Data

US 2015/0311682 A1 Oct. 29, 2015

Related U.S. Application Data

(60) Continuation-in-part of application No. 14/157,266, filed on Jan. 16, 2014, which is a division of application No. 13/446,322, filed on Apr. 13, 2012, now Pat. No. 8,981,632.

(60) Provisional application No. 61/490,219, filed on May 26, 2011.

(51) Int. Cl.
*H01T 21/02* (2006.01)
*F02P 15/00* (2006.01)
(Continued)

(52) U.S. Cl.
CPC ..... *H01T 21/02* (2013.01); *F02P 15/00* (2013.01); *H01T 13/14* (2013.01); *H01T 13/20* (2013.01)

(58) Field of Classification Search
CPC ..... H01T 13/38–13/39; H01T 13/20; H01T 13/14; H01T 13/00; H01T 13/06; C08J 7/04; C08J 7/042; C04B 41/009; C04B 2111/00482; C03C 17/02
USPC ..... 313/118–145; 445/7; 427/379–380, 427/372.2
See application file for complete search history.

(56) References Cited

U.S. PATENT DOCUMENTS 4,084,976 A 4/1978 Hinton
4,092,264 A 5/1978 Tsang et al.
(Continued)

FOREIGN PATENT DOCUMENTS

JP S63-301479 12/1988
JP 2001-244043 9/2001
JP 2002-056949 2/2002

OTHER PUBLICATIONS

Search Report for PCT/US2012/033497, dated Oct. 31, 2012.
(Continued)

*Primary Examiner* — Anne Hines
*Assistant Examiner* — Jose M Diaz
(74) *Attorney, Agent, or Firm* — Elizabeth A. Peters; Barnes & Thornburg LLP

(57) ABSTRACT

A method of applying a coating to a spark plug insulator comprises the steps of forming a slurry solution and applying the slurry solution as a first coating to an insulative sleeve configured for use in a spark plug. The method further includes the step of heat treating the insulative sleeve to a temperature of between about 500 degrees Celsius and about 1000 degrees Celsius for between about 10 minutes and about 2 hour(s). Still further, the method includes the step of applying a second coating overlying at least a portion of the first coating, wherein the second coating comprises an organic binder.

18 Claims, 5 Drawing Sheets

(51) Int. Cl.
*H01T 13/14* (2006.01)
*H01T 13/20* (2006.01)

(56) References Cited

U.S. PATENT DOCUMENTS

| | | | |
|---|---|---|---|
| 4,250,426 | A | 2/1981 | Nakajima et al. |
| 4,267,483 | A | 5/1981 | Nakajima et al. |
| 4,415,828 | A | 11/1983 | Mizuno et al. |
| 4,972,811 | A | 11/1990 | Baresel et al. |
| 5,109,178 | A | 4/1992 | Yoshida et al. |
| 5,274,298 | A | 12/1993 | Cassidy et al. |
| 5,550,424 | A | 8/1996 | Jennrich et al. |
| 5,952,769 | A | 9/1999 | Budaragin |
| 6,051,529 | A | 4/2000 | Brezny |
| 6,060,821 | A | 5/2000 | Suzuki et al. |
| 6,090,191 | A | 7/2000 | Atlanova et al. |
| 6,166,481 | A | 12/2000 | Knapp et al. |
| 6,521,671 | B1 | 2/2003 | Ishikawa et al. |
| 6,548,944 | B1 | 4/2003 | Morita |
| 6,589,900 | B1 | 7/2003 | Kotze |
| 6,858,975 | B1 | 2/2005 | Matsutani |
| 6,888,293 | B2 | 5/2005 | Roessler et al. |
| 2002/0033659 | A1 | 3/2002 | Nishikawa et al. |
| 2002/0036451 | A1 | 3/2002 | Nishikawa et al. |
| 2003/0122462 | A1 | 7/2003 | Nishikawa et al. |
| 2003/0127959 | A1 | 7/2003 | Nishikawa et al. |
| 2004/0135483 | A1 | 7/2004 | Nunome |
| 2006/0055297 | A1 | 3/2006 | Koyama et al. |
| 2007/0040487 | A1 | 2/2007 | Kyuno et al. |
| 2007/0188063 | A1 | 8/2007 | Lykowski |
| 2009/0256461 | A1 | 10/2009 | Walker, Jr. |

OTHER PUBLICATIONS

Office Action issued in parent U.S. Appl. No. 13/446,322 and dated Jan. 17, 2014.

Mul et al., "Soot Oxidation Catalyzed by a Cu/K/Mo/Cl Catalyst: Evaluation of the Chemistry and Performance of the Catalyst," Applied Catalysis B: Environmental, No. 6, pp. 339-352 (1995).

Neeft, et al., "Feasibility Study Towards a Cu/K/Mo/(Cl) Soot Oxidation Catalyst for Application in Diesel Exhaust Gases," Applied Catalysis B: Environmental, No. 11, pp. 365-382 (1997).

Non-Final Office Action issued in U.S. Appl. No. 14/157,266 on Feb. 10, 2015.

English Translation of Office Action issued on Oct. 6, 2015 in Japanese Application No. 2014-512840.

METHOD OF APPLYING A COATING TO A SPARK PLUG INSULATOR

CROSS REFERENCE TO RELATED APPLICATIONS

This application is a continuation-in-part of co-pending U.S. patent application Ser. No. 14/157,266, filed Jan. 16, 2014, and entitled "Anti-Fouling Spark Plug and Method of Making," which is a divisional of U.S. patent application Ser. No. 13/446,322, now U.S. Pat. No. 8,981,632, filed Apr. 13, 2012, and entitled "Anti-Fouling Spark Plug and Method of Making," which claims the benefit of U.S. Provisional Application No. 61/490,219, filed May 26, 2011, and entitled "Anti-Fouling Spark Plug and Method of Making," the disclosures of which are incorporated herein by reference in their entireties.

BACKGROUND

In general, spark plugs include an insulative sleeve having a central axial bore through which a center electrode extends. The insulating sleeve is positioned within, and secured to, a metal shell that serves as a mounting platform and interface to an internal combustion engine. The metal sleeve also supports a ground electrode that is positioned in a particular spaced relationship relative to the center electrode so as to generate a spark gap. The insulating sleeve includes a shaped tip portion that resides in a recessed end portion of the metal shell. The shaped tip portion is configured to protect the electrode from engine heat and products of combustion. The spark plug is typically mounted to an engine cylinder head and selectively activated to ignite a fuel/air mixture in an associated engine cylinder.

Over time, products of combustion or combustion deposits build up around the center electrode and insulative sleeve, particularly the shaped tip portion. This build up of combustion product inhibits spark formation across the spark gap. A significant build up of combustion products may foul the spark plug and result in ignition failure, i.e., the combustion products completely block the spark from forming between the center and ground electrodes due to an electrical short circuit formed from the combustion products. Combustion deposit build up is particularly problematic during cold starts. During cold starts, complete combustion of the air/fuel mixture is seldom achieved which results in an increased generation of electrically conductive combustion deposits. As a result of continuous cold starts, electrically conductive combustion deposits build up, resulting in an electrical short circuit between the center electrode and the electrically grounded portion of the spark plug.

Previous, attempts to address combustion deposit build up issues have included silicone oil coatings and particulate vanadium oxide deposition on the insulating sleeve. These coatings have failed to adequately address the issue—suffering from inadequate performance at elevated temperature, inadequate endurance, or insufficient reduction of combustion deposit build up.

Accordingly, there is a need for a spark plug which has a decreased susceptibility to electrically conductive combustion deposit build up in the insulative sleeve.

SUMMARY

In accordance with one embodiment, a method of applying a coating to a spark plug insulator may comprise the steps of forming a slurry solution and applying the slurry solution as a first coating to an insulative sleeve configured for use in a spark plug. The method may further include the step of heat treating the insulative sleeve to a temperature of between about 500 degrees Celsius and about 1000 degrees Celsius for between about 10 minutes and about 2 hours. Still further, the method may further include the step of applying a second coating overlying at least a portion of the first coating, wherein the second coating comprises an organic binder.

In some embodiments, the heat treating step may include heating the insulative sleeve to a temperature of about 650 degrees Celsius for about 1 hour.

In some embodiments, the organic binder of the second coating may have a burnout temperature of between about 200 degrees Celsius and about 450 degrees Celsius.

In some embodiments, the organic binder may be selected from the group consisting of polyoxyethylene, polyvinyl alcohol (PVA), polyethylene oxide (PEO), polyvinyl butyral (PVB), acrylic, Paraffin wax, and cellulose.

In some embodiments, the method may further include the steps of assembling the insulative sleeve having the first and second coatings applied thereto into a spark plug and/or installing the spark plug within an engine head of a vehicle such that the spark plug is in communication with a combustion engine of the vehicle. The method may further include the steps of operating the vehicle such that the combustion reaches a temperature of at least 300 degrees Celsius but less than 400 degrees Celsius and/or burning off carbon deposits within the spark plug.

In some embodiments, the slurry solution may be formed of a transition metal compound or a combination of transition metal compounds, and an alkali metal compound.

In some embodiments, the transition metal compound may be selected from the group consisting of copper nitrate, copper chloride, copper oxide, copper carbonate, ammonium heptamolybdate 4 hydrate, molybdenum chloride, potassium paramolybdate, and combinations of two or more of the foregoing compounds.

In some embodiments, the transition metal compound may comprise a transition metal selected from the group consisting of chromium, iron, zirconium, lead, molybdenum, tungsten, vanadium, niobium, tantalum, copper, silver, gold, nickel, platinum, and palladium.

In some embodiments, the alkali metal compound may be selected from the group consisting of lithium, sodium, potassium, cesium, and a combination of two or more of the foregoing alkali metals.

In accordance with another embodiment, a method of applying a coating to a spark plug insulator may comprise the steps of forming a slurry solution, drying the slurry solution to form a solid mixture, and heat treating the solid mixture to a temperature of between about 500 degrees Celsius and about 1000 degrees Celsius for between about 10 minutes and about 2 hours. The method may further include the steps of grinding the heated solid mixture into a powder, dispersing the powder into an aqueous suspension, and applying the aqueous suspension to a spark plug insulator.

In some embodiments, the slurry solution may be formed of a transition metal compound or a combination of transition metal compounds, and an alkali metal compound.

In some embodiments, the heat treating step may convert the solid mixture into an amorphous metal complex.

In some embodiments, the method may further include the step drying the aqueous solution.

In some embodiments, the aqueous suspension may not be heat treated after being applied to the spark plug insulator.

In accordance with a further embodiment, a method of applying a coating to a spark plug insulator may comprise the steps of dry mixing two or more tri-metal salts to form a dry mixture. The method may further include the step of heat treating the dry mixture to a temperature of between about 500 degrees Celsius and about 1000 degrees Celsius for between about 10 minutes and about 2 hours. Still further, the method may further include the steps of grinding the heated solid mixture into a powder, dispersing the powder into an aqueous suspension, and/or applying the aqueous suspension to a spark plug insulator.

In some embodiments, the heat treating step may convert the solid mixture into an amorphous metal complex.

In some embodiments, the method may further include the step drying the aqueous solution.

In some embodiments, the aqueous suspension may not be heat treated after being applied to the spark plug insulator.

DETAILED DESCRIPTION

Figure 1:
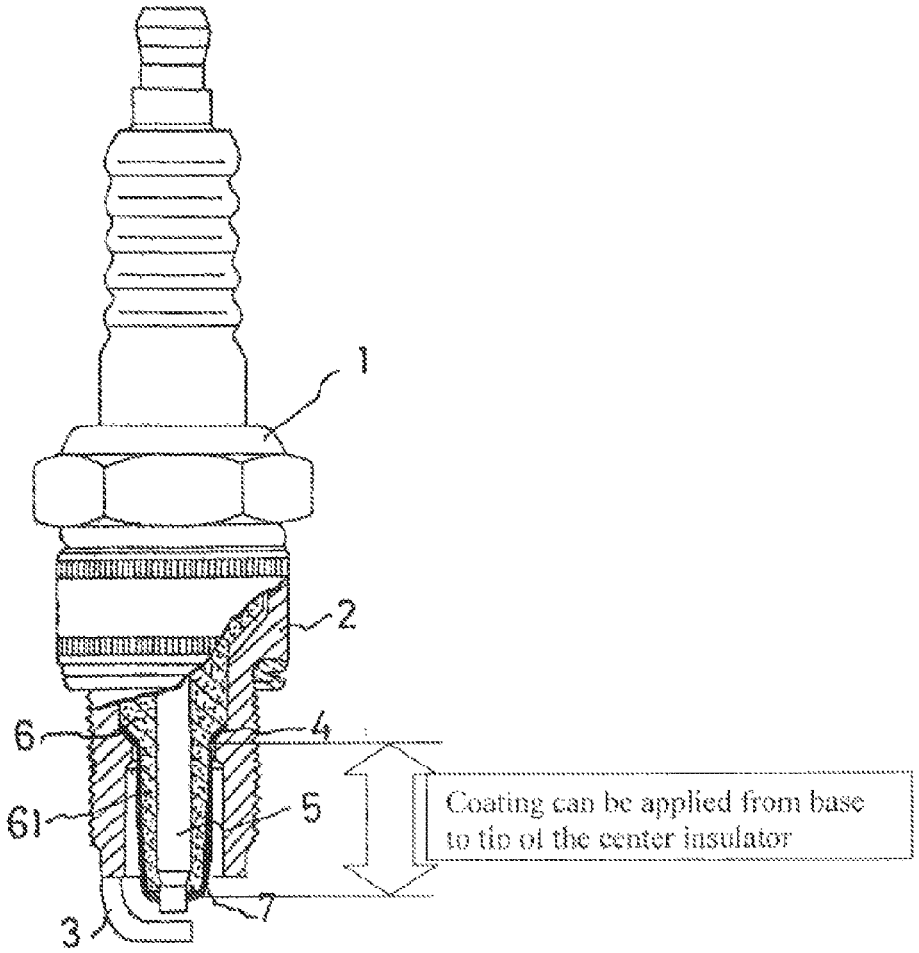
FIG. 1 is a side view of a spark plug, partly shown in cross section.

The coating, as described herein, is a substantially continuous coating. A substantially continuous coating, as defined herein, describes a coating which has no breaks or gaps visible to the naked eye and covers a portion of shaped tip portion on the exterior surface of the insulative sleeve. The coating thickness can range from a molecular monolayer to several micrometers in thickness. In one embodiment, the monolayer may be 5 to 15 micrometers in thickness. In other embodiments, the coating has a thickness of 1-10 micrometers.

Suitable transition metal compounds comprise one or more transition metals. Exemplary transition metals include chromium, molybdenum, tungsten, zirconium, iron, lead, vanadium, niobium, tantalum, copper, silver, gold, nickel, platinum, and palladium. Exemplary transition metal compounds include oxides and carbonates of the foregoing transition metals. For simplicity of handling, it is desirable for the transition metal compound to be water soluble. Exemplary water soluble compounds include copper nitrate, copper chloride, ammonium heptamolybdate 4 hydrate, molybdenum chloride, potassium paramolybdate, and combinations of two or more of the foregoing compounds.

In some embodiments, the coating may comprise a combination of an early transition metal compound and a late transition metal compound. Exemplary early transition metals include chromium, molybdenum, tungsten, vanadium, niobium, and tantalum. Exemplary late transition metals include copper, silver, gold, nickel, platinum, and palladium. An exemplary combination comprises a molybdenum compound and a copper compound.

The alkali metal compound may comprise lithium, sodium, potassium, cesium, or a combination of two or more of the foregoing alkali metals. For simplicity in handling it is desirable for the alkali metal compound to be water soluble. Exemplary water soluble alkali metal compounds include potassium chloride, potassium carbonate, potassium bicarbonate, potassium nitrate, potassium hydroxide, and combinations of two or more of the foregoing compounds.

The molar ratio of the transition metal compound to the alkali metal compound (transition metal/alkali metal) can be 1:1 to 16:1. When the coating comprises late and early transition metal compounds, the molar ratio of the late transition metal compound to early transition metal compound to alkali metal compound can be 1:0.5:1 to 1:7:1.

Surprisingly, it has been found that the coatings described above are not sufficiently conductive, at the thicknesses described herein, to interfere with the operation of the spark plug. Without being bound by theory, it is speculated that the coating may function as a catalyst to facilitate combustion either during a cold start or during subsequent operation, thus reducing or removing the combustion deposit build up on the surface. Alternatively, the coating may absorb oxygen which it can then provide during combustion at the interface of the insulative sleeve and the combustion products, thus facilitating more complete combustion.

The coating is formed on the insulative sleeve or insulator by forming a slurry or solution comprising the transition metal compound or combination of transition metal compounds. The solution can further comprise the alkali metal compound. The slurry or solution is applied to the insulative sleeve by any appropriate method such as painting, dip coating, spray coating and the like. In some embodiments, the slurry is an aqueous slurry. In some embodiments, the solution is an aqueous solution. The slurry or solution can comprise up to 70 weight percent of the transition metal compound or combination of transition metal compounds, based on the total weight of the slurry or solution. Within this range the amount of transition metal compound(s) in the slurry or solution can be 0.1 to 10 weight percent, or, more specifically, 0.1 to 5 weight percent. Slurries can be used at higher weight percents than solutions. Solutions, if made too concentrated can have solubility issues. The slurry or solution can comprise up to 70 weight percent of the alkali metal compound, based on the total weight of the slurry or solution. Within this range, the amount of alkali metal compound in the slurry or solution can be 0 to 10 weight percent, or more specifically 0.25 to 7.5 weight percent. In another embodiment, the alkali metal compound in the slurry or solution can be 0.5 to 5 weight percent.

The applied slurry or solution is allowed to air dry at room temperature to form a coated insulative sleeve. The coated insulative sleeve can then be treated at an elevated temperature, such as 70 to 150 degrees Celsius for 30 minutes to 60 hours. The coated insulative sleeve is then calcined at a temperature of 475 to 950 degrees Celsius for a period of 30 minutes to several hours. Within this range, the calcination time can be 30 minutes to 1.5 hours. After calcining, alkali metal solution or slurry can be applied and drying and calcining repeated to form a coating with alkali metal compound primarily at the surface.

The alkali metal can also be applied separately in a two-stage process. In this scenario, a first coating comprising a mixture of transition metals may be applied and calcined as described above. The sleeve thus coated may be then further subjected to a second coating of an alkali metal solution, and then finally calcined as described above. The first coating might comprise either of the transition metals only or a mixture containing alkali metal. The two-stage process can effectively result in surface enrichment of the final coating with alkali metal.

An exemplary spark plug is shown in FIG. 1. The spark plug, 1, has a metal shell 2, a ground electrode 3, a center electrode 5, an insulative sleeve 6, a shaped tip portion 61 of the insulative sleeve 6, and a coating 7, disposed on the insulative sleeve. The longitudinal extent of the coating (from center electrode to metal shell) can vary. Importantly, the coating should form a continuous coating around the circumference of the insulative sleeve in at least one location.

The invention is further illustrated by the following non-limiting examples.

Several coatings were screened for conductivity and impact on combustion deposit accumulation/removal using the following procedure. An aqueous solution of the metal compounds was coated onto half of an alumina slide, leaving one side uncoated to function as a control. After coating the slide was air dried and calcined at 475-975 degrees C. for 60 minutes. Calcination temperatures were approximately 625-650 degrees Celsius for the Cu/Mo/K mixes and higher for CuO and $V_2O_5$. Resistivity (electrical resistance) was measured using a Fluke 1507 Megohmmeter. Higher resistance means less conductivity. The candidates were then further evaluated for soot burn off (conductive deposit removal). The entire strip was coated with soot (combustion products) and placed within a vycor tube in a tube furnace and a cole-parmer digital temperature controller was used to adjust the temperature from ambient temperature to about 625° C. at a heating rate of 8.5° C./minute. Observations were made on achieving 200, 300, 400, 450, 475, 500, 525, 550, 575, 600 and 625° C. Soot loss was visually estimated and recorded. Results are shown in FIGS. 2, 3 and 4.

Figure 2:
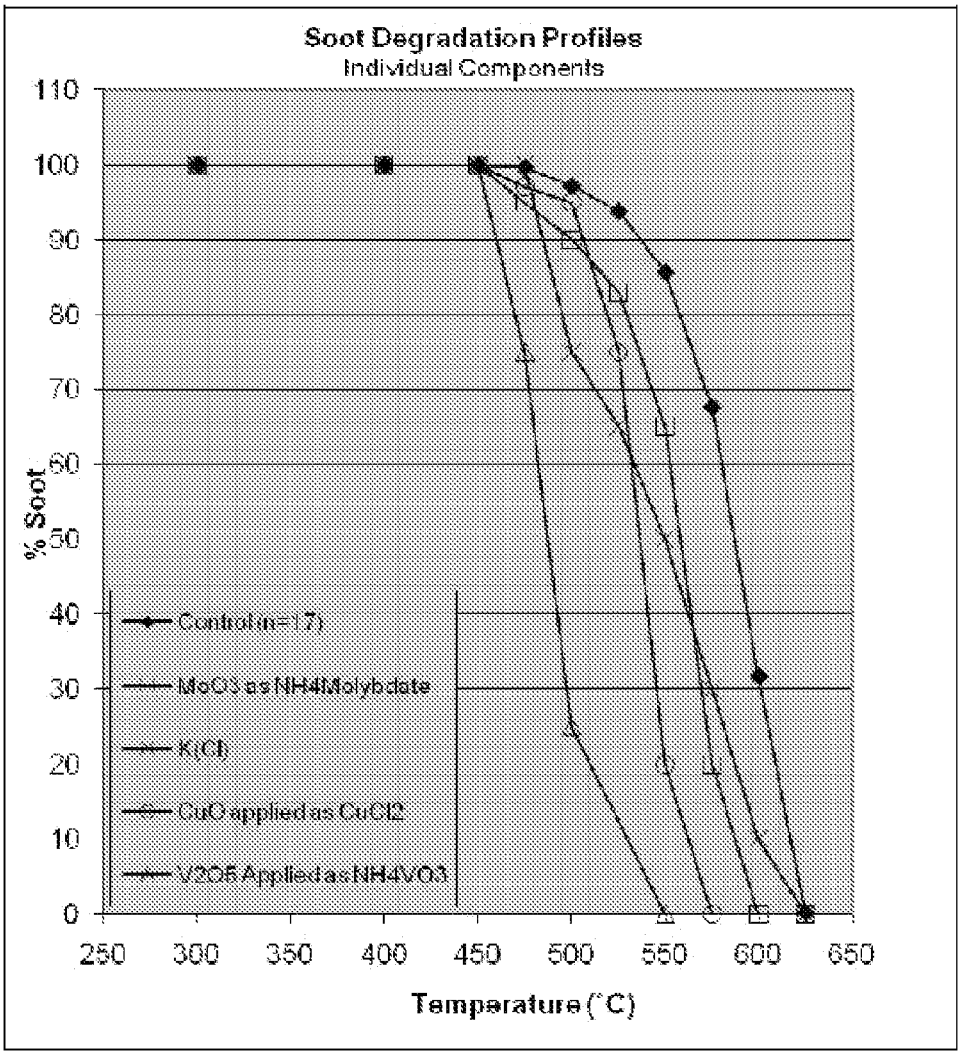
FIGS. 2-4 are graphical representations of data described in the examples.

FIG. 2 shows soot degradation curves for the individual components as well as vanadium pentoxide (as a comparison). Each individual component shows an improvement over the control but only moderately good results compared to vanadium pentoxide.

Figure 3:
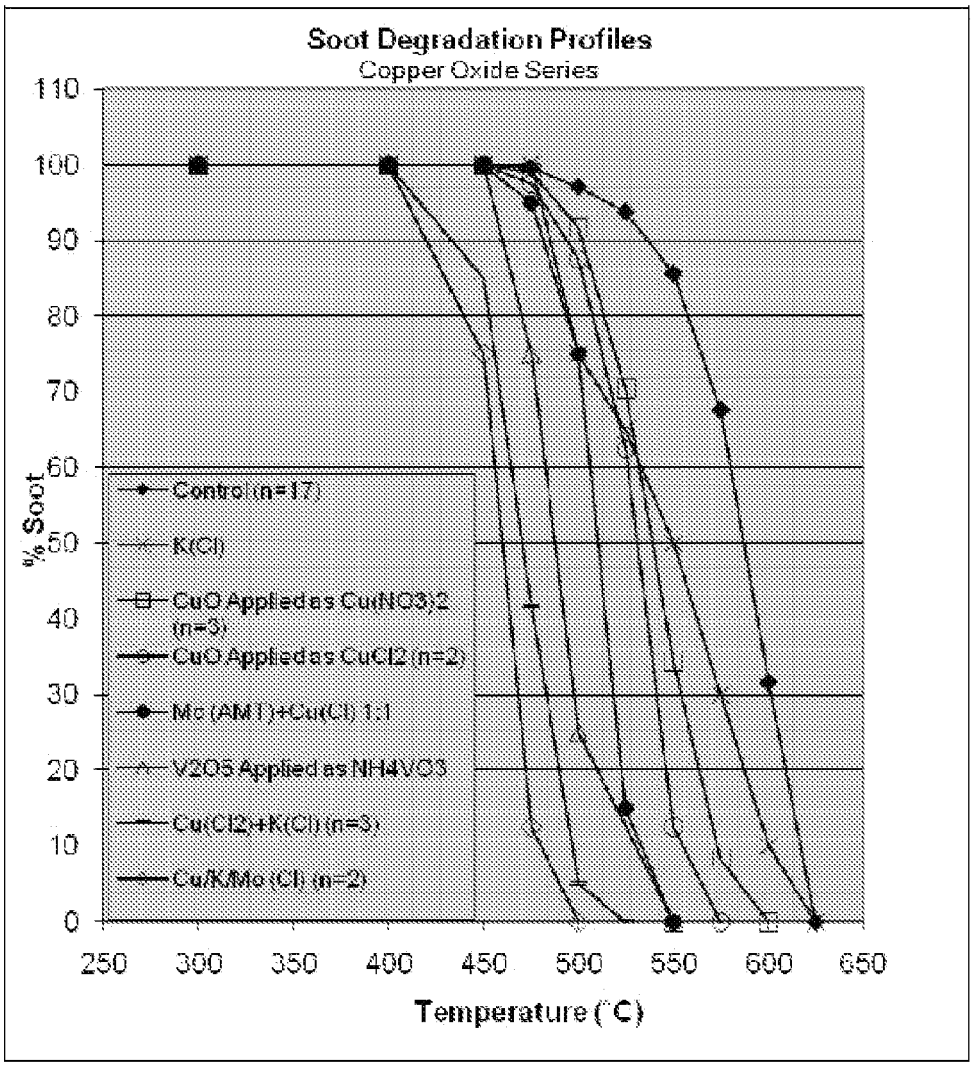

FIG. 3 shows soot degradation curves for the individual components, vanadium pentoxide (as a comparison), two component mixtures containing a copper compound, and the tri component mixture containing a copper compound, a molybdenum compound and a potassium compound. The tri component mixture started clearing soot at a lower temperature than vanadium pentoxide and cleared the soot faster with complete removal of the soot at a lower temperature than the vanadium pentoxide.

Figure 4:
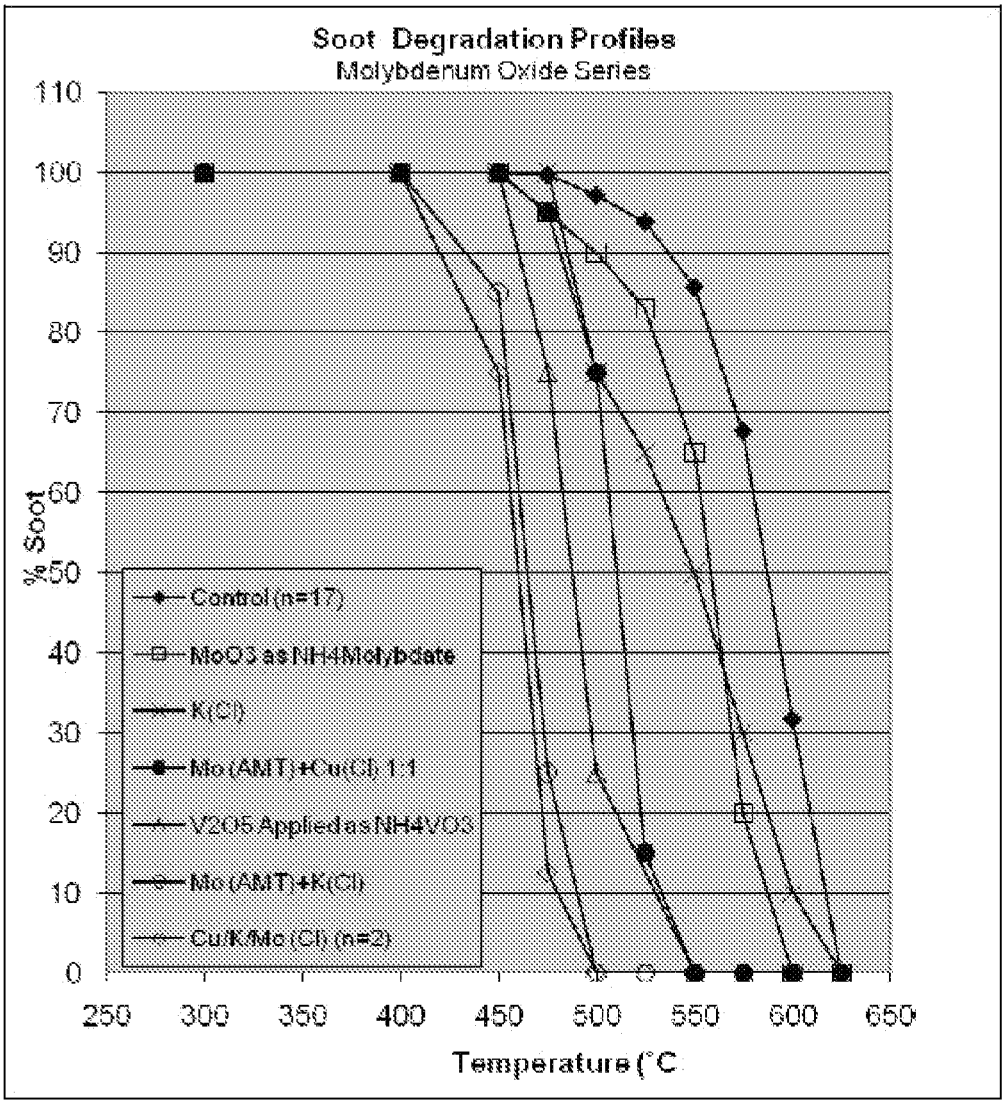
Figure 5:
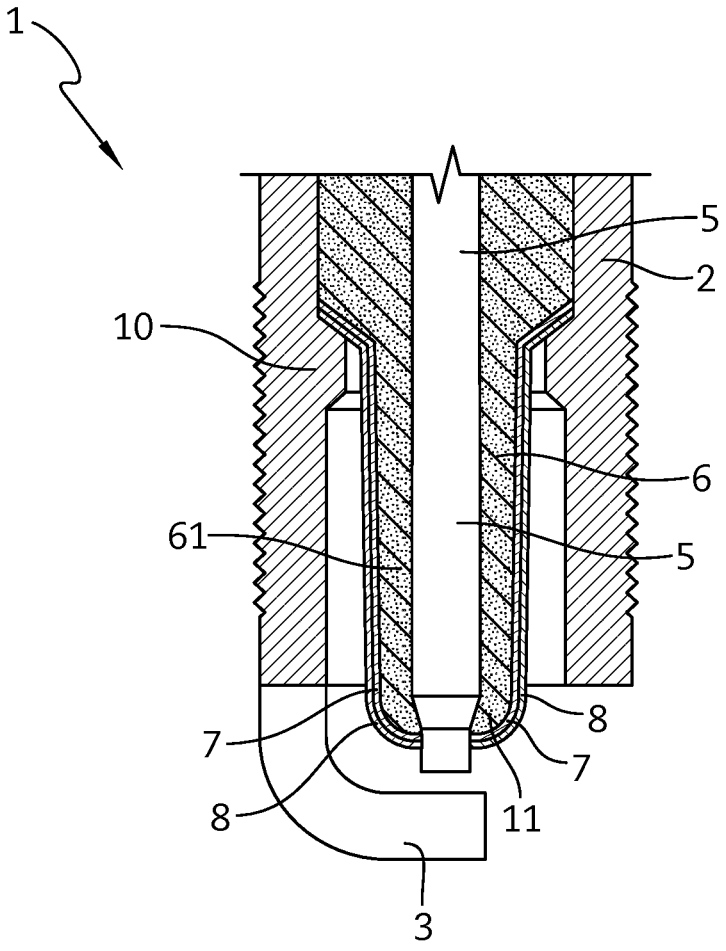
FIG. 5 is a side view of a spark plug, partly shown in cross section.

FIG. 4 shows soot degradation curves for molybdenum and potassium as individual components, vanadium pentoxide (as a comparison), two component mixtures containing a molybdenum compound, and the tri component mixture containing a copper compound, a molybdenum compound and a potassium compound. The tri component mixture demonstrates the best performance with the molybdenum/potassium combination also demonstrating good performance.

Illustrative methods of applying any of the coatings of the present disclosure will not be discussed in detail. As noted above, previous applications of coatings involved mixing the components of the coating to form a slurry or solution, applying the slurry or solution to the insulative sleeve 6 by painting, dip coating, spray coating, and the like, air drying the slurry or solution, heat treating the coated insulative sleeve 6 at an elevated temperature, and calcining the coated insulative sleeve 6. Optionally, the applying and calcining steps may be repeated. While this process has been acceptable, the coating is generally only capable of burning off carbon deposits at combustion chamber temperatures of at least 400 degrees Celsius during engine application. Carbon deposits begin to build up at 100 or 200 degrees Celsius, so burn-off of carbon deposits only at greater than 400 degrees Celsius can lead to a build-up of carbon deposits within the spark plug. This method will be referenced herein as the "prior art" method.

The present application provides improved methods of applying any of the coatings of the present disclosure that provide for burn-off of carbon deposits at lower combustion engine temperatures, for example, at temperatures of about 325 degrees Celsius and above. In an illustrative embodiment, any of the coatings of the present disclosure may be applied to a shaped tip 61 of the insulative sleeve 6 (i.e., all or a portion of the insulative sleeve that is spaced from the metal shell 2, which is disposed between a gasket 10 and an end 11 of the insulative sleeve 6, and which is exposed to the combustion chamber) to create a first coating 7. The first coating 7 may be applied in any manner described herein or any other suitable manner. After application of the first coating 7, the insulative sleeve 6 is heat treated at a temperature of between about 500 degrees Celsius and about 1000 degrees Celsius for a period of between about 10 minutes and about 2 hours. In illustrative embodiments, the insulative sleeve 6 is heat treated at a temperature of between about 650 degrees Celsius and about 850 degrees Celsius for about 1 hour. In another illustrative embodiment, the insulative sleeve 6 may be heat treated at a temperature of about 650 degrees for about 1 hour.

After heat treatment, an organic binder solution may be applied to the heat treated first coating 7 on the insulative sleeve 6. The organic binder second coating 8 is then air dried at a temperature of between about 60 degrees Celsius and about 120 degrees Celsius. The organic binder second coating 8 or overcoating serves as an ablative coating that is effective in anti-cold fouling at lower temperatures of between about 300 degrees Celsius and about 400 degrees Celsius. The organic binder second coating 8 expands the effective anti-fouling temperature range of the insulative sleeve 6 by providing a lower temperature limit at which carbon deposits may burn off. The organic binder second coating only works during initial engine "break-in", which is the first time the engine reaches 300 degrees Celsius or greater for the first time. Regardless, during this period of time, the carbon deposits that may have built up during manufacture, short trip movement of the vehicle, driving in cold weather, and/or any other movement of the vehicle that does not cause the engine to reach at least 300 degrees Celsius burn off with the organic binder second coating 8. Once the organic binder second coating 8 burns off, the first coating 7 applied directly to the insulative sleeve 6 functions to burn off carbon deposits at temperatures of at least 400 degrees Celsius.

In an illustrative embodiment, the organic binder second coating 8 may comprise polyoxyethylene (for example, Zusoplast 9002 by Ceramco). In other embodiments, the organic binder second coating 8 may alternatively or additionally include one or more organic binders having a decomposed or burn-off temperature of between about 200 degrees Celsius and about 450 degrees Celsius. Exemplary organic binders included, but are not limited to, polyvinyl alcohol (PVA), polyethylene oxide (PEO), polyvinyl butyral (PVB), acrylic, cellulose, and the like, or any other suitable binders having a burn-off temperature in the defined range.

In illustrative embodiments, the first coating 7 may be applied to the entire insulative sleeve 6 that is spaced from the metal shell 2, which is disposed between a gasket 10 and an end 11 of the insulative sleeve 6, and which is exposed to the combustion chamber. In such embodiments, the second coating 8 may be applied to an entirety of the first coating 7 or may be applied to one or more portions of the first coating 7. In further illustrative embodiments, the first coating 7 may be applied to only a portion of the insulative sleeve 6 between the gasket 10 and the tip 11 of the insulative sleeve 6. In such embodiments, the second coating 8 may be applied to an entirety of the first coating 7, only one or more portions of the first coating 7, and/or may extend over and around the first coating 7 such that the second coating 8 is applied directly to portions of the insulative sleeve 6 not having the first coating 7 applied thereto.

The following table summarizes the effectiveness of the method described above including a first coating and a second, organic binder coating (Sample 2):

| Type | Coating | Burn out Starting Temperature | Burn out Completion Temperature |
|---|---|---|---|
| Control | None | 500+ degrees Celsius | 600+ degrees Celsius |
| Sample 1 | Catalytic Coating and Heat Treatment (Prior Art Method) | 400 degrees Celsius | 475 degrees Celsius |
| Sample 2 | Catalytic Coating, Heat Treatment, and Ablative Coating | 325 degrees Celsius (first time only) | 425-450 degrees Celsius |

In another illustrative method of applying any of the coatings of the present disclosure, the step of heat treating the insulative sleeve 6 after application of a coating to the insulative sleeve 6 may be eliminated. More particularly, the method may include the steps of mixing the components of the coating to form a slurry or solution, drying the slurry or solution to create a solid mixture, and heat treating the solid mixture at a temperature of between about 500 degrees Celsius and about 1000 degrees Celsius for a period of between about 10 minutes and about 2 hours to form an amorphous metal complex. In illustrative embodiments, the insulative sleeve 6 is heat treated at a temperature of between about 650 degrees Celsius and about 850 degrees Celsius for about 1 hour. In another illustrative embodiment, the insulative sleeve 6 may be heat treated at a temperature of about 650 degrees for about 1 hour. A metal complex is a material that consists of a metal atom or ion in a center of the material, wherein the metal atom or ion is surrounded by ligands. In an illustrative embodiment, metal complex refers to a network of copper/Molybdum/potassium atoms/ions with some Nitrogen and/or Chloride branch structure. In other words, the metal complex may be a solid solution of Cu/Mo/K/Cl, which maintains an amorphous nature, in comparison to metallic crystal.

Alternatively, any number of tri-metal salts (mixture of 3 metal salts, for example, ammonium molybdate tetrahydrate, copper nitrate, and potassium nitrate) may be dry-mixed and heat treated at a temperature of between about 500 degrees Celsius and about 1000 degrees Celsius for a period of between about 10 minutes and about 2 hours to create the amorphous metal complex. In illustrative embodiments, the insulative sleeve 6 is heat treated at a temperature of between about 650 degrees Celsius and about 850 degrees Celsius for about 1 hour. In an illustrative embodiment, the dry mixture may be heat treated at a temperature of about 650 degrees for about 1 hour.

Regardless of the manner in which the amorphous metal complex is achieved, the heat treated metal complex is ground into a powder and re-dispersed into an aqueous suspension. One or more organic binder materials, such as acrylic, polyoxyethylene, and/or other suitable binder materials, may be added to the suspension to provide both rheology characteristics for coating application and increased bonding strength of the coating to insulator materials or substrates. The organic binder(s) may also serve as an ablative coating, which will expand the range of effective temperatures for which the coating will function. The aqueous suspension is then applied to one or more portions of the insulative sleeve 6 and the aqueous solution is dried, for example, for between about 30 minutes and about 2 hours. In this embodiment, the step of heat treating individual insulative sleeves is eliminated by heat treating the slurry, solution, or dry mixture prior to application to the insulative sleeve. In this manner, time and energy are saved by eliminated this additional step from the manufacturing process, thereby reducing the costs associated with manufacturing the insulative sleeve and overall spark plug. The elimination of the step of heat treating the insulative sleeve with coating thereon also reduces the opportunity for defects in the insulative sleeve caused by the heat treating process.

The following table summarizes the effectiveness of the method described above in which the step of heat treating the insulative sleeve has been eliminated (Sample 2):

| Type | Coating | Burn out Starting Temperature | Burn out Completion Temperature |
|---|---|---|---|
| Control | None | 500+ degrees Celsius | 600+ degrees Celsius |
| Sample 1 | Catalytic Coating and Heat Treatment (Prior Art Method) | 400 degrees Celsius | 475 degrees Celsius |
| Sample 2 | Catalytic Coating with No Heat Treatment of Insulative Sleeve | 375 degrees Celsius | 425-450 degrees Celsius |

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

All ranges disclosed herein are inclusive of the endpoints, and the endpoints are combinable with each other.

All cited patents, patent applications, and other references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another.

We claim:

1. A method of applying a coating to a spark plug insulator, the method comprising the steps of:

forming a slurry solution;

applying the slurry solution as a first coating to an insulative sleeve configured for use in a spark plug;

heat treating the insulative sleeve at a temperature of between about 500 degrees Celsius and about 1000 degrees Celsius for between about 10 minutes and about 2 hours; and applying a second coating overlying at least a portion of the first coating, wherein the second coating comprises an organic binder.

2. The method of claim 1, wherein the heat treating step includes heating the insulative sleeve at a temperature of about 650 degrees Celsius for about 1 hour.

3. The method of claim 1, wherein the organic binder of the second coating has a burn out temperature of between about 200 degrees Celsius and about 450 degrees Celsius.

4. The method of claim 1, wherein the organic binder is selected from the group consisting of polyoxyethylene, polyvinyl alcohol (PVA), polyethylene oxide (PEO), polyvinyl butyral (PVB), acrylic, Paraffin wax, and cellulose.

5. The method of claim 1, further including the steps of:

assembling the insulative sleeve having the first and second coatings applied thereto into a spark plug;

installing the spark plug within an engine head of a vehicle such that the spark plug is in communication with a combustion engine of the vehicle;

operating the vehicle such that the combustion reaches a temperature of at least 300 degrees Celsius but less than 400 degrees Celsius; and burning off carbon deposits within the spark plug.

6. The method of claim 1, wherein the slurry solution is formed of a transition metal compound or a combination of transition metal compounds, and an alkali metal compound.

7. The method of claim 6, wherein the transition metal compound is selected from the group consisting of copper nitrate, copper chloride, copper oxide, copper carbonate, ammonium heptamolybdate 4 hydrate, molybdenum chloride, potassium paramolybdate, and combinations of two or more of the foregoing compounds.

8. The method of claim 6, wherein the transition metal compound comprises a transition metal selected from the group consisting of chromium, iron, zirconium, lead, molybdenum, tungsten, vanadium, niobium, tantalum, copper, silver, gold, nickel, platinum, and palladium.

9. The method of claim 6, wherein the alkali metal compound is selected from the group consisting of lithium, sodium, potassium, cesium, and a combination of two or more of the foregoing alkali metals.

10. A method of applying a coating to a spark plug insulator, the method comprising the steps of:

forming a slurry solution;

drying the slurry solution to form a solid mixture;

heat treating the solid mixture at a temperature of between about 500 degrees Celsius and about 1000 degrees Celsius for between about 10 minutes and about 2 hours;

grinding the heated solid mixture into a powder;

dispersing the powder into an aqueous suspension; and applying the aqueous suspension to a spark plug insulator.

11. The method of claim 10, wherein the slurry solution is formed of a transition metal compound or a combination of transition metal compounds, and an alkali metal compound.

12. The method of claim 11, wherein the heat treating step converts the solid mixture into an amorphous metal complex.

13. The method of claim 10, further including the step drying the aqueous solution.

14. The method of claim 13, wherein the aqueous suspension is not heat treated after being applied to the spark plug insulator.

15. A method of applying a coating to a spark plug insulator, the method comprising the steps of:

dry mixing two or more tri-metal salts to form a dry mixture;

heat treating the dry mixture at a temperature of between about 500 degrees Celsius and about 1000 degrees Celsius for between about 10 minutes and about 2 hours;

grinding the heated solid mixture into a powder;

dispersing the powder into an aqueous suspension; and applying the aqueous suspension to a spark plug insulator.

16. The method of claim 15, wherein the heat treating step converts the solid mixture into an amorphous metal complex.

17. The method of claim 15, further including the step drying the aqueous solution.

18. The method of claim 17, wherein the aqueous suspension is not heat treated after being applied to the spark plug insulator.

* * * * *